US005460144A

United States Patent [19]

Park et al.

[11] Patent Number: 5,460,144

[45] Date of Patent: Oct. 24, 1995

[54] COMBUSTION EFFICIENCY ENHANCING APPARATUS

[75] Inventors: Jong H. Park, 1206 Ho. Byuksan Apt. 2-Dong, 275, Banghak-Dong, Dobong-Gu, Seoul; Young H. Choi, Kwangmyong, both of Rep. of Korea

[73] Assignee: Jong H. Park, Seoul, Rep. of Korea

[21] Appl. No.: 285,211

[22] Filed: Aug. 3, 1994

[30] Foreign Application Priority Data

Aug. 5, 1993 [KR] Rep. of Korea ..... 1993-15211

[51] Int. Cl.[6] ..... F02M 33/00; F02M 27/04

[52] U.S. Cl. ..... 123/538; 210/222

[58] Field of Search ..... 123/536, 537, 123/538, 539, 1 A, 3, 590; 210/695, 222, 223; 335/302, 306

[56] References Cited

U.S. PATENT DOCUMENTS

| | | | |
|---|---|---|---|
| 4,401,089 | 8/1983 | Csaszer et al. | 123/536 |
| 4,590,915 | 5/1986 | Yamauchi et al. | 123/590 |
| 4,605,523 | 8/1986 | Smillie | 123/538 |
| 4,862,858 | 9/1989 | Goldsberry | 123/538 |
| 5,044,346 | 9/1991 | Tada et al. | 123/536 |
| 5,124,045 | 6/1992 | Janczak et al. | 210/695 |
| 5,129,382 | 7/1992 | Stamps et al. | 123/536 |
| 5,254,247 | 10/1993 | Kashami | 123/538 |
| 5,356,534 | 10/1994 | Zimmerman et al. | 210/222 |
| 5,377,648 | 1/1995 | Iwata | 123/538 |

*Primary Examiner*—Marguerite Macy

*Attorney, Agent, or Firm*—Burns, Doane, Swecker & Mathis

[57] ABSTRACT

Fluid fuel traveling through a fuel line is ionized by the action of infrared rays emitted from a ceramic material disposed within two cases containing multiple compartments through which the fuel line extends. Both cases contain pairs of permanent magnets which establish magnetic flux patterns tending to break-up the fuel into small particles. A resonator is mounted in a compartment of one case and a resonance vibrator is mounted opposite said resonator in a compartment of the other case. Two layers of a material emitting infrared rays are disposed on opposite sides of the fuel line with an additional magnetic member being disposed between said layers.

12 Claims, 4 Drawing Sheets

N
S
N
S
N
S
N
S
N
S
N
S
6
6
a
g
b
c
d
3B
3B 6
6
h
S
S
e
f

COMBUSTION EFFICIENCY ENHANCING APPARATUS

BACKGROUND OF THE INVENTION

The invention is related to providing a combustion efficiency enhancing apparatus installed on the fuel supply line for activating the molecular motion of liquid fuel, thereby enhancing the combustion efficiency of liquid fuel.

PRIOR ART

Recently, there have been developed many permanent magnet apparatuses provided at the fuel line for preventing paraffine oil components from adhering to the inner surface of a pipe, thereby increasing the engine performance. However, these apparatuses lack prevention means against the thermal phenomena due to the fission action occurring at that time of a liquid fuel being ion-resolved with a magnetic field.

A typical technology is disclosed in U.S. Pat. No. 4,711,271 issued to Mr. Weisenbarger which discloses an arrangement of permanent magnets having a magnetic flux pattern to increase the density of the magnetic flux in order to reduce the adherence of the fuel percipient to the inner wall of the conduit. In other words, at least two permanent magnets and numerous metallic pole pieces are placed in a housing, such that at least two permanent magnets are positioned in opposition at the periphery of a conduit with a pole on each magnet positioned along the conduit being directly adjacent to the periphery of the conduit. However, the apparatus relates to a magnetic flux pattern which provides the flux path in one direction, for example from S pole to N pole, relative to the fuel pipe.

Also, U.S. Pat. No. 5,124,045 issued to Mr. Janczak teaches a magnet arrangement. The magnet arrangement comprises a permanent magnet disposed in a position adjacent the exterior surface of a fuel line, two parallel spaced longitudinally disposed magnetic plates located parallel to a longitudinal axis of the fuel line and means for maintaining a spacing between the magnetic pole plates, for forming a multi-pole, multi-axial magnetic flux. The permanent magnet arrangement provides long life and adaptability to conditions where vibration, shock, heat and electrical interference are present. However, it does not deal with the problem of the heat generation due to the ionization fission of liquid fuel at all.

In light of these points, the main object of the invention is to provide a combustion efficiency enhancing apparatus for activating the fission motion to promote the ionization of liquid fuel, thereby improving the combustion efficiency.

Another object of the invention is to provide a combustion efficiency enhancing apparatus for enabling liquid fuel to pass through the passages of far-infrared rays and electromagnetic waves to promote the ionization as well as the particle separation.

Another object of the invention is to provide a combustion efficiency enhancing apparatus including an electro magnetic wave passage which forms multi-pole, multi-axis magnetic patterns to promote the division of liquid fuel into particles.

Still another object of the invention is to provide a combustion efficiency enhancing apparatus including a far-infrared ray emitting portion for coating far-infrared ray emitting ceramic material on a plurality of multi-pole, multi-axis permanent magnets which forms multi-pole, multi-axis magnetic patterns and for generating the resonance of a system to prolong the life thereof.

SUMMARY OF THE INVENTION

The invention comprises a body including first and second cases divided into a plurality of compartments, which are hinged to each other to receive a fuel supply conduit therein during the enclosing: a resonance portion provided in a compartment of one case; a resonance vibrating portion installed opposite the resonance portion in a compartment of the other case; a plurality of multi-pole permanent magnets mounted in other (remaining) compartments of the two cases, respectively; at least one far-infrared ray layer coated in a predetermined thickness on the outer surfaces of the permanent magnets, the resonance portion and the resonance vibrating portion, for generating far-infrared rays; and at least one magnet plate mounted on the far-infrared layer to wrap around the fuel supply conduit in the contact condition, in which a plurality of permanent magnets are aligned along the longitudinal axis of the fuel supply conduit to form magnetic flux patterns a, b in the face to face arrangement of S-poles, magnetic flux patterns c, d between the arrangements of S-pole adjacent to the inlet of the fuel supply conduit and N-pole far away therefrom, a magnetic flux pattern g in an arrangement of the S-pole of one permanent magnet and the N-pole of other permanent magnet acting to each other and magnetic flux patterns i, j in an arrangement of the magnet plate on the permanent magnets, thereby to increase the strength of the magnetic field, converging the magnetic field at the center portion of the fuel supply conduit and the far-infrared ray layer made of ceramic materials acts to enhance the ionization of fuel flowing in the fuel supply conduit, the wave-length of the far-infrared ray is within 12μ to 1400μ, the resonance portion has a resonant frequency of 10 Hz to 180 Hz and the resonance vibrating portion enables a system to be vibrated at the resonant frequency to divide the liquid fuel into particles.

BRIEF DESCRIPTION OF THE DRAWINGS

The invention will be now described in detail with reference to the accompanying drawings.

DETAILED DESCRIPTION OF PREFERRED EMBODIMENTS OF THE INVENTION

Figure 1:
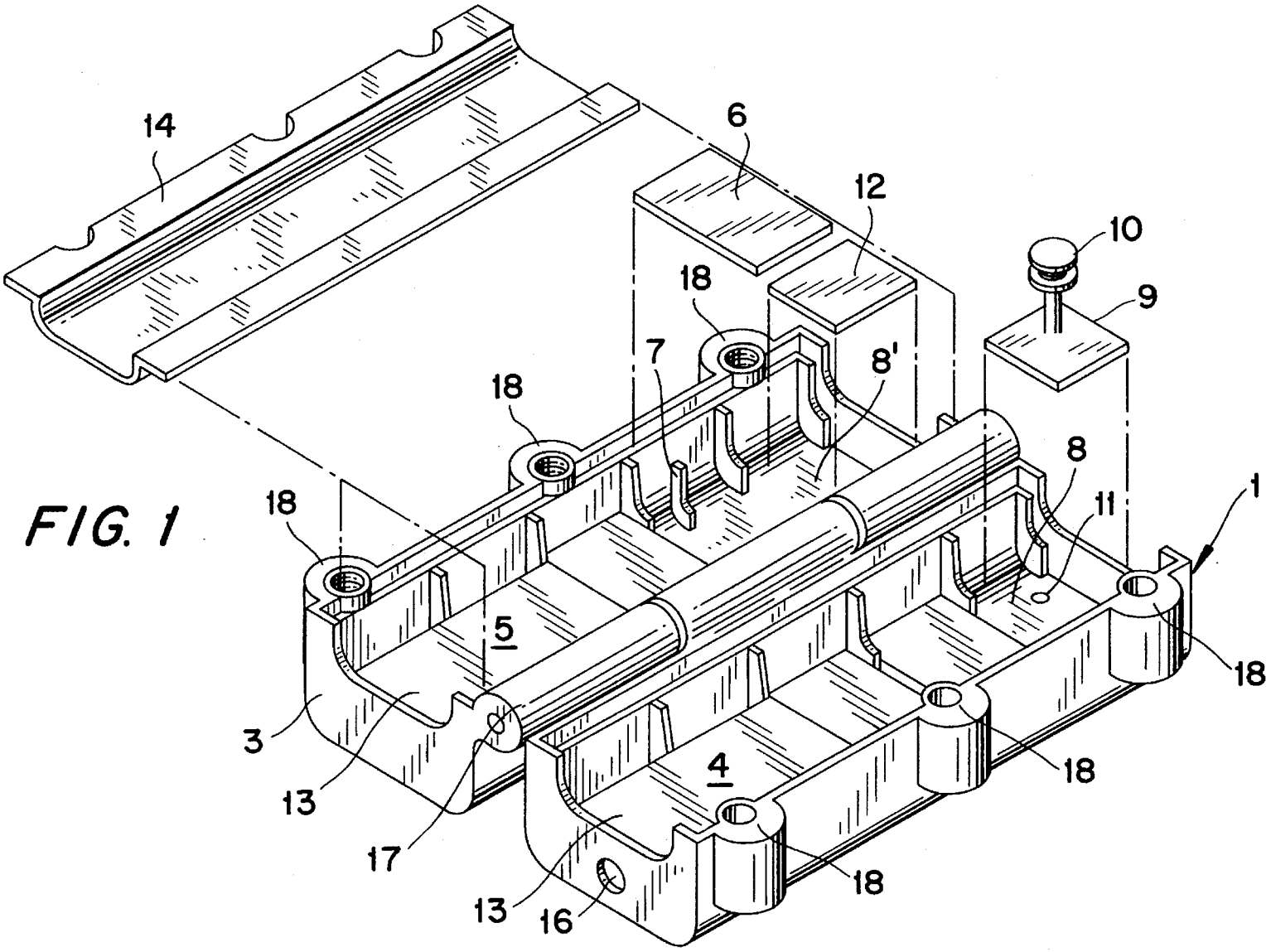
FIG. 1 is an exploded perspective view illustrating a combustion efficiency enhancing apparatus according to the principle of the invention.
Figure 4:
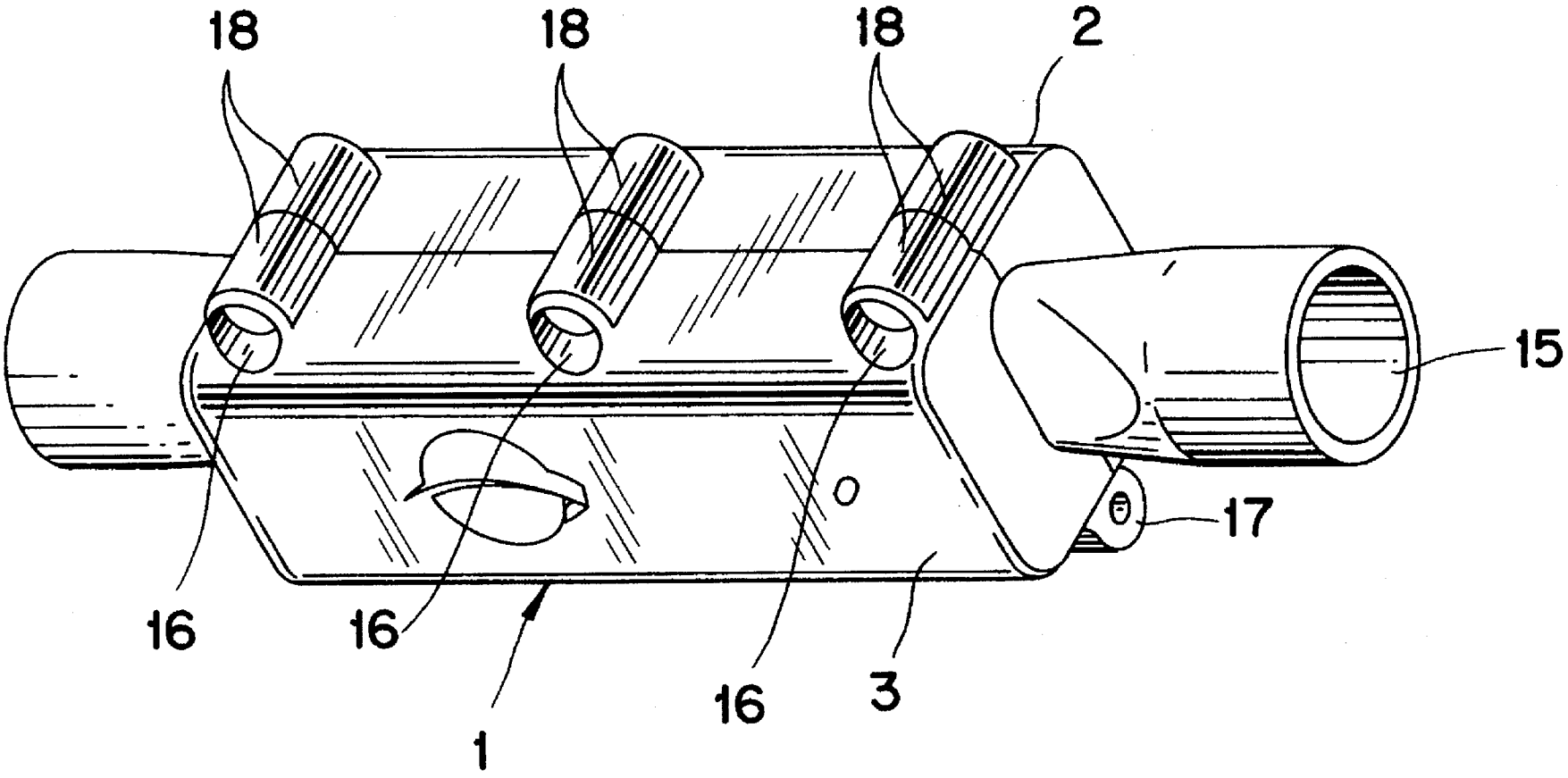
FIG. 4 is a perspective view illustrating the assembly of a combustion fuel efficiency enhancing apparatus with a fuel supply conduit according to the invention.

As shown in FIG. 1 and FIG. 4, an apparatus comprises a body 1 including two cases 2 and 3. These cases 2 and 3, made of plastic or synthetic resin materials, are moulded to have a plurality of compartments 4 and 5 for receiving at least one multi-pole permanent magnet 6, respectively. Each of the multi-pole permanent magnets 6 is fixed on supporting members 7 formed in the compartments 4 and 5.

A compartment 8 not receiving a permanent magnet 6 in the case 2 includes a printed circuit board 9 fixed therein. The printed circuit board 9 includes general elements constituting a vibrating circuit (not shown), a resonator 10 and an light emitting diode 11 in a proper arrangement. The resonator 10 includes a core and a coil for resonating at a low frequency, for example 60–180 Hz.

Also, a compartment 8' not receiving a permanent magnet 6 in the case 3 includes a resonant vibrator 12 fixed therein. The resonant vibrator 12 is a piezo-electric element designed to vibrate at the resonant frequency of the resonator 10. The vibration causes the separation of liquid fuel flowing through the fuel supply conduit as described later.

When a plurality of multi-pole permanent magnets 6, the resonator 10 and the resonant vibrator 12 are respectively mounted in compartments 4, 5, 8 and 8', layers 13 of a ceramic material inherently capable of emitting infrared rays in the far-infrared range are coated at a predetermined thickness on the upper surfaces of the permanent magnets 6, the resonator 10 and the resonant vibrator 12. Magnetic plates 14 (only one shown in FIG. 1) extend across the far-infrared ray layers 13 to induce a magnetic-field as described later in detail. Each plate 14 is of U-shape to receive a fuel supply conduit for both cases 2 and 3. Hole 16 is formed on one side of the case 2 for a power source line (not shown) connected to the printed circuit board. Hinge portions 17 are formed to couple common sides of cases 2 and 3 together by means of a hinge pin. On the other sides of cases 2 and 3 there are formed a predetermined number of coupling portions with a screw hole 18 to seal the cases 2 and 3 to each other by means of screws.

Figure 2:
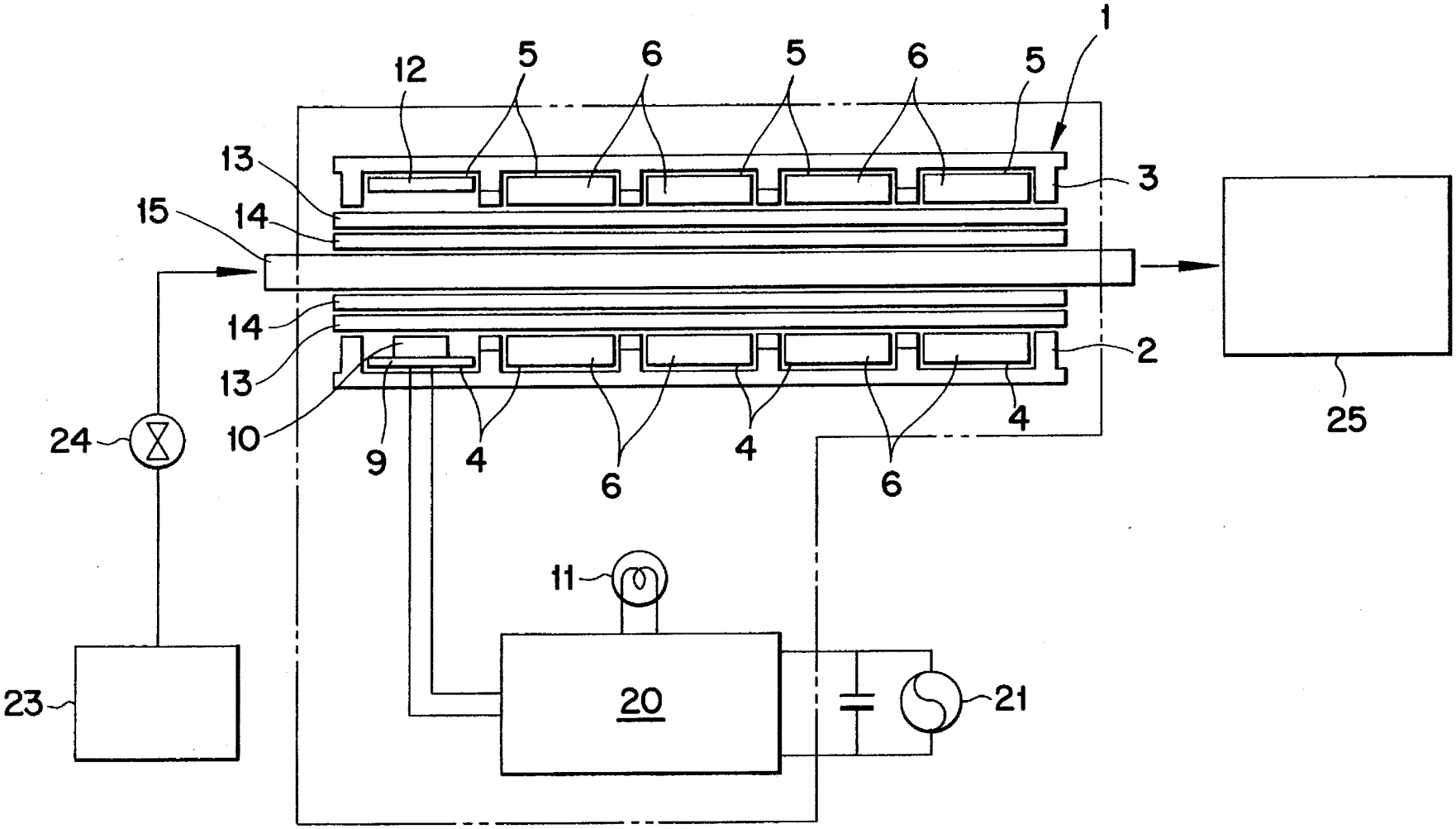
FIG. 2 is a block diagram illustrating the configuration of a system adapting the invention.

The apparatus is assembled as shown in FIG. 2, in which the body 1 includes the lower case 2 and the upper case 3. In case 2 the printed circuit board 9 provided with the resonant 10 and a plurality of multi-pole permanent magnets 6 are arranged in order along the longitudinal axis of the fuel supply conduit 15 In the case 3 the resonance vibrator 12 and a plurality of multi-pole permanent magnets 6 are arranged in order. Also, over the multi-pole permanent magnets 6, the resonator 10 and the resonator vibrator 12 there are coated far-infrared ray layers 13. The magnetic plates 14 extend across the far-infrared ray layers 13 in contact with the fuel supply conduit 15. The liquid fuel is supplied from a fuel tank 23 to the fuel supply conduit 15 by means of a pump 24.

On the other hand, an oscillating circuit 20 mounted on the printed circuit board 9 is oscillated at a predetermined frequency of 10 Hz to 180 Hz, when a power source 21 is applied. The oscillating circuit 20 is adjusted to be operated at a different frequency according to the type of automobiles, for example 10 Hz for a passenger car, 20 Hz for a medium sized passenger car and 180 Hz for a diesel engine. At that time, the resonator 10 is resonated at the frequency of the oscillating circuit. The resonance action causes the vibration of the resonant vibrator 12 disposed against the resonator 10 to divide liquid fuel flowing through the fuel supply conduit 15 into particles. The far-infrared rays radiated from the far-infrared ray layers 13 have a wavelength of 14μ–1400μ and in conjunction with the magnetic plate 14 and a plurality of multi-pole permanent magnets 6 induces an ionization of the fuel and divides fuel into particles.

The ionization and particle breaking actions prevent the attachment of the impurities, for example paraffine, to the inner wall of the fuel conduit and removes the wax-phenomena of fuel. Also, the vibration of the resonant vibrator 12 enables the circuits of the far-infrared ray layers 13 and multi-pole permanent magnets 6 to compensate each other as well as to prolong their life.

Figure 3A:
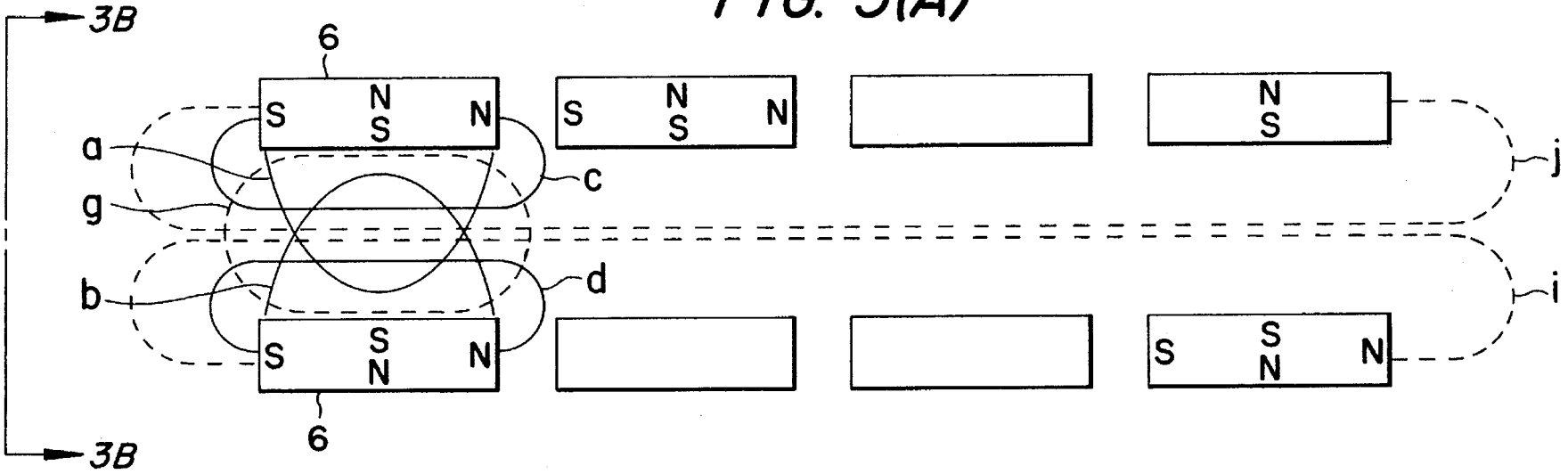
FIGS. 3A and 3B are views illustrating a variety of magnetic flux patterns in an arrangement of multi-pole permanent magnets according to the invention, with FIG. 3B being viewed in the direction of arrows 3B—3B in FIG. 3A.
Figure 3B:
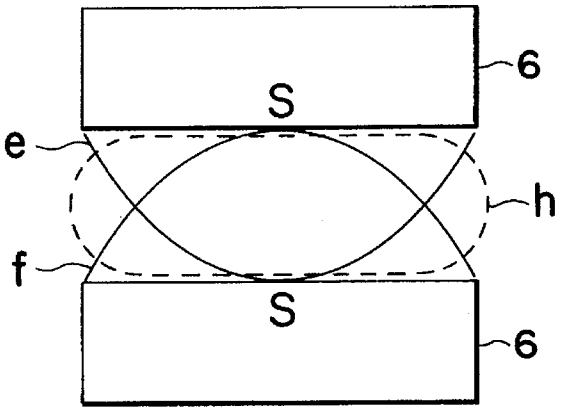

Particularly, magnetic flux patterns as shown in FIGS. 3A and 3B are formed by the four pairs of multi-pole permanent magnets 6 and the magnetic plate 14. FIG. 3A is a view illustrating a pair of the multi-pole permanent magnets 6 facing each other. The multi-pole permanent magnets 6 form magnetic flux patterns a and b with their S-pole planes facing each other, thereby overlapping their magnetic flux. The S-poles at the entering side, the N-poles at the exiting side and the S-poles in the longitudinal direction form magnetic flux patterns c and d facing each other. Thus, the magnetic flux patterns a, b, c, d and the magnetic flux patterns e, f, each of which has horizontally and vertically directed components in the fuel supply conduit 15, result from magnetic flux patterns g and h as shown in a dotted line in FIGS. 3A and 3B. The magnetic force is converged on the fuel supply conduit 15.

Furthermore, the magnetic flux patterns g and h include four stages in the four pairs of the multi-pole permanent magnets arrangement. The configuration forces liquid fuel to be passed through four separate stages of the magnetic flux patterns and causes liquid fuel to be divided into smaller particles in addition to being ionized during the breaking up of fuel by the vibration of the vibrator 12. Also, liquid fuel has a flow resistance when moving to the next magnetic flux pattern to promote the breaking up of liquid fuel more and more. Thereafter, such a breaking-up procedure is performed two more times.

The magnetic plate 14 is mounted over the far-infrared ray layers 13 contacting with the outer periphery of the fuel supply conduit 15, so that it forms magnetic flux patterns i and j, thereby constituting the fuel supply conduit 15 as a magnetic flux pattern passage. Also, it is noted that the strength of a magnetic flux pattern is 580 to 600 gauss, preferably 600 gauss.

Case 2 and 3 face each other with the fuel supply conduit 15 being inserted between the magnetic plates 14. Next, the combustion efficiency enhancing apparatus is completely assembled with screws (not shown) being threaded into screw holes 16, respectively.

As described above with reference to FIG. 1 to FIG. 4, the invention is expected to divide liquid fuel into macro-sized particles and ionize the separate materials of Oxide nitride, Carbons, etc. in order to induce the complete combustion of an engine, thereby increasing the combustion efficiency by 15% to 30% over the normal combustion ratio. Also, the invention is simply installed thereon without the cutting up of a fuel supply conduit. The vibration of the system prolongs the life of the ceramic materials of a far-infrared ray layer and a multi-pole permanent magnet. As a result, the invention has a longer life of up to 50,000 hours.

What is claimed is:

1. Apparatus for ionizing a fluid fuel and breaking-up the fuel into particles, comprising:

first and second cases arranged in opposite relationship, with a fuel line extending between the first and second cases, each case including a plurality of compartments, said compartments of each case facing said fuel line;

a resonator mounted in a compartment of said first case;

a resonance vibrator mounted opposite said resonator in a compartment of said second case;

a plurality of first multi-pole permanent magnets mounted in respective compartments of said first case and arranged adjacent one another in a direction parallel to the fuel line;

a plurality of second multi-pole permanent magnets mounted in respective compartments of said second case and situated opposite respective ones of said first magnets;

at least one layer of a material emitting infrared rays in the far-infrared range, said resonator and said first magnets being disposed on one side of said at least one layer and said resonance vibrator and said second magnets being disposed on an opposite side of said at least one layer; and a magnetic member extending across said layer and encompassing said fuel line.

2. The apparatus according to claim 1, wherein said resonator comprises an oscillating circuit for oscillating the resonator at a frequency of the oscillating circuit.

3. The apparatus according to claim 1, wherein there are two said layers of material disposed on opposite sides of said fuel line, said magnetic member being disposed between said layers.

4. The apparatus according to claim 1, wherein said magnetic member comprises two magnetic plates disposed on opposite sides of said fuel line.

5. The apparatus according to claim 1, wherein each of said first magnets is arranged relative to its associated second magnet such that mutually facing surfaces of associated first and second magnets comprise S-poles, and surfaces of said associated magnets facing away from one another comprise N-poles.

6. The apparatus according to claim 5, wherein there are four first magnets and four second magnets.

7. The apparatus according to claim 1, wherein there are four first magnets and four second magnets.

8. The apparatus according to claim 5, wherein each first magnet and its associated second magnet together create a magnetic flux pattern of approximately 600 gauss.

9. The apparatus according to claim 1, wherein each first magnet and its associated second magnet together create a magnetic flux pattern of approximately 600 gauss.

10. The apparatus according to claim 5, wherein said far-infrared range of said layer of material is from 14μ to 20μ.

11. The apparatus according to claim 1, wherein said far-infrared range of said layer of material is from 14μ to 20μ.

12. The apparatus according to claim 1, wherein said first and second cases are hinged together.

* * * * *